US005413302A

United States Patent [19]

Ferster

[11] Patent Number: 5,413,302

[45] Date of Patent: May 9, 1995

[54] ANTI-SLIDE COASTER

[76] Inventor: Reinhold C. Ferster, 90A Grandview, Amherst, N.Y. 14228

[21] Appl. No.: 68,511

[22] Filed: May 27, 1993

[51] Int. Cl.[6] ..... A47G 29/00

[52] U.S. Cl. ..... 248/346.1; 248/154; 248/205.3

[58] Field of Search ..... 248/346.1, 146, 205.3, 248/500, 154; 215/100.5; D7/510, 624

[56] References Cited

U.S. PATENT DOCUMENTS

| | | | |
|---|---|---|---|
| 2,131,878 | 10/1938 | Lawrence | 215/100.5 |
| 2,163,309 | 6/1939 | McConnell | 215/100.5 |
| 3,040,472 | 6/1962 | Miller | 248/346.1 |
| 3,847,324 | 11/1974 | Uchanski et al. . | |
| 4,040,549 | 8/1977 | Sadler . | |
| 4,137,356 | 1/1979 | Shoemaker et al. . | |
| 4,759,525 | 7/1988 | Cross et al. | 248/346.1 |
| 4,836,488 | 6/1989 | Ross . | |
| 4,978,566 | 12/1990 | Scheurer et al. . | |
| 5,018,695 | 5/1991 | Bishop . | |

FOREIGN PATENT DOCUMENTS

| | | | |
|---|---|---|---|
| 462645 | 3/1937 | United Kingdom | 248/346.1 |
| 9106445 | 5/1991 | WIPO | 248/346.1 |

*Primary Examiner*—Ramon O. Ramirez
*Assistant Examiner*—Derek J. Berger
*Attorney, Agent, or Firm*—Hodgson, Russ, Andrews, Woods & Goodyear

[57] ABSTRACT

An inexpensive coaster for resisting sliding and tipping over of a beverage container or other implement during, for example, turbulence on a commercial airliner. The lower surface is slide-resistant and the upper surface adhesively attaches to the bottom of the beverage container so as to remain attached when the beverage container is picked up for drinking. The coaster receives the bottom of the beverage container and extends outwardly therefrom to increase the beverage container footprint for greater stability against tipping over. In accordance with an alternative embodiment, the upper surface has an indent for receiving the beverage container or other implement bottom.

17 Claims, 2 Drawing Sheets

Fig. 1.
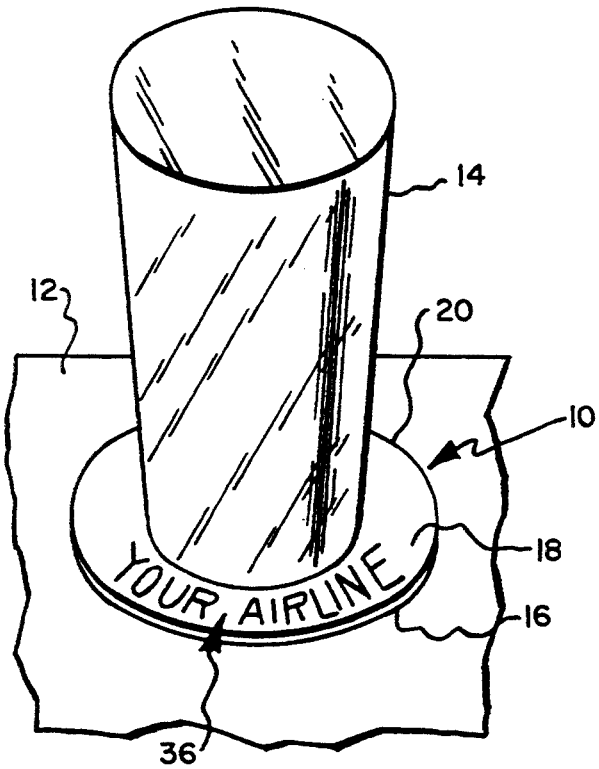
Fig. 4.
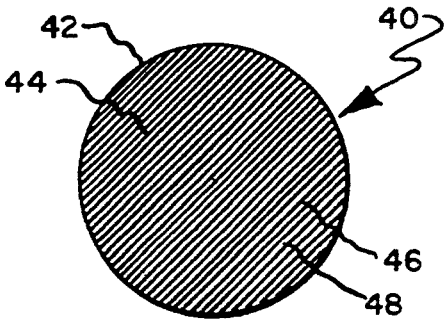
Fig. 5.
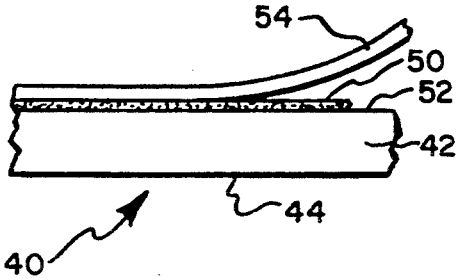
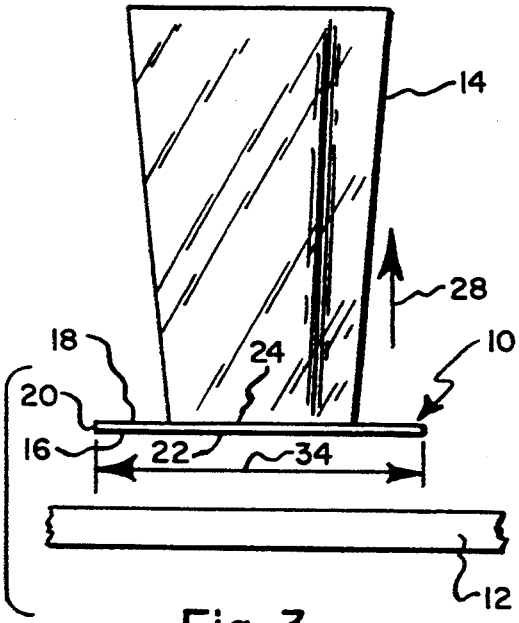
Fig. 3.
Fig. 2.
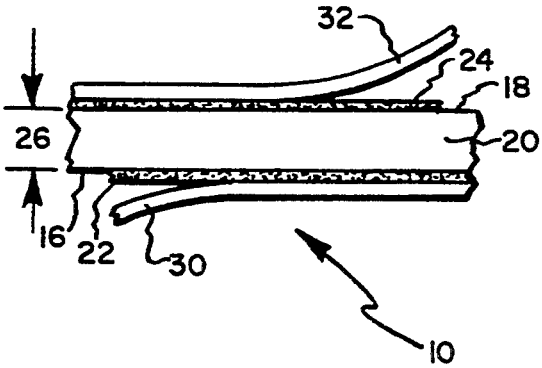

ANTI-SLIDE COASTER

The present invention relates generally to coasters usable underneath liquid containers such as drinking glasses, coffee cups, disposable cups, soft drink cans, and the like, as well as plates and other implements.

During travel on commercial airplanes there is a tendency for a beverage container to slide across the tray if it is not adequately restrained during, for example, turbulence. Passengers typically effect the necessary restraint by holding onto their beverage containers. It would, however, be desirable to provide a coaster which resists slipping or sliding of the beverage container across the tray or tipping over of the beverage container during turbulence so as to free up the passengers for greater comfort as well as to reduce spills.

U.S. Pat. No. 5,018,695 to Bishop discloses a disposable coaster comprising upper and lower pads separated by a liquid barrier material to prevent liquid condensing on a cold container from running off onto a table surface or one's clothes. The lower pad is formed of a closed-cell plastic foam material. A series of adhesive patches are arranged on the upper surface whereby the coaster can be releasably attached to the bottom surface of a liquid container. The coaster will remain adhered to the container while a person is drinking liquid from the container. The adhesive force is so light that the person can easily remove the coaster from the container. The coaster diameter is shown to be greater than the container diameter. Advertising is provided along the perimeter of the upper surface.

U.S. Pat. No. 4,836,488 to Ross discloses a coaster which has no-slip textured material on the bottom, the no-slip characteristic provided by the friction of the textured material. It is disclosed that this textured material can be made of rubber. A hook and elastic cord are provided for attaching a cup to a coaster. The user drinks with the coaster attached. The coaster diameter is shown to be greater than the cup diameter.

U.S. Pat. No. 3,847,324 to Uchanski et al discloses a double adhesive back material which on one side is adhered to a bottom surface of a disposable cup or plate and a peelable paper on the other side for removal for adhering the other side to the table top. The material diameter is disclosed to be not more than the cup diameter. The adhesive attachment is thus said to provide stability. In one embodiment the adhesive material is applied to the bottom of a supporting member (having the shape of a cup of small height) which has an opening for receiving a drink-containing cup. The supporting member thus allows the cup to be easily picked up for drinking with stability being maintained when it is set back down. However, it is considered desirable not to have a separate supporting member, which adds to expense and inconvenience.

U.S. Pat. No. 4,137,356 to Shoemaker et al discloses a place mat or coaster having projections of a high friction material on its top and bottom surfaces to provide anti-skid characteristics.

Other art disclosing other types of coaster or cup mounts includes U.S. Pat. Nos. 4,978,566 to Scheurer et al and 4,040,549 to Sadler.

None of the above patents provides an inexpensive disposable coaster suitable for use on hospital carts and trays, cars, airplanes, trains, or other vehicles for resisting tipping over or sliding of a beverage container or other implement across a tray or table surface or the like and which does not unduly interfere with the normal use of the implement by a passenger.

It is accordingly an object of the present invention to provide resistance to sliding of a beverage container or other implement along any surface on which it is set down.

It is another object of the present invention to provide resistance to tipping over of a beverage container or other implement.

It is yet another object of the present invention to provide a coaster which is disposable and inexpensive for providing such resistance to sliding and tipping over of a beverage container or other implement.

It is a further object of the present invention to provide such a coaster which is easy to use and does not unduly interfere with a normal use of the beverage container or other implement by, for example, a passenger.

In order to inexpensively and suitably resist tipping over and sliding of a beverage container or other implement across a surface on which it is placed, in accordance with the present invention there is provided a coaster comprising a thin disc including a slide-resistant lower surface and an upper surface having means for adhesively attaching the disc to the bottom of the implement so as to remain attached thereto when the beverage container or other implement is picked up for, for example, drinking.

In accordance with an alternative embodiment of the present invention, a coaster has a slide-resistant lower surface and an indent in the upper surface for receiving the bottom of a beverage container or other implement for use suitably by children, recovering patients, patients being rehabilitated, and the like.

The above and other objects, features, and advantages of the present invention will be apparent in the following detailed description of the preferred embodiments thereof when read in conjunction with the accompanying drawings wherein the same reference numerals denote the same or similar parts throughout the several views.

BRIEF DESCRIPTION OF THE DRAWINGS

FIG. 1 is a perspective view of a coaster in accordance with the present invention in use with a beverage container.

FIG. 2 is an enlarged side view of a portion thereof with backing paper attached prior to use.

FIG. 3 is a side view thereof illustrating its use as the beverage container is picked up for drinking.

FIG. 4 is a bottom view of a coaster in accordance with an alternative embodiment of the present invention.

FIG. 5 is an enlarged side view of a portion thereof with backing paper attached prior to use

DETAILED DESCRIPTION OF THE PREFERRED EMBODIMENTS

Figure 6:
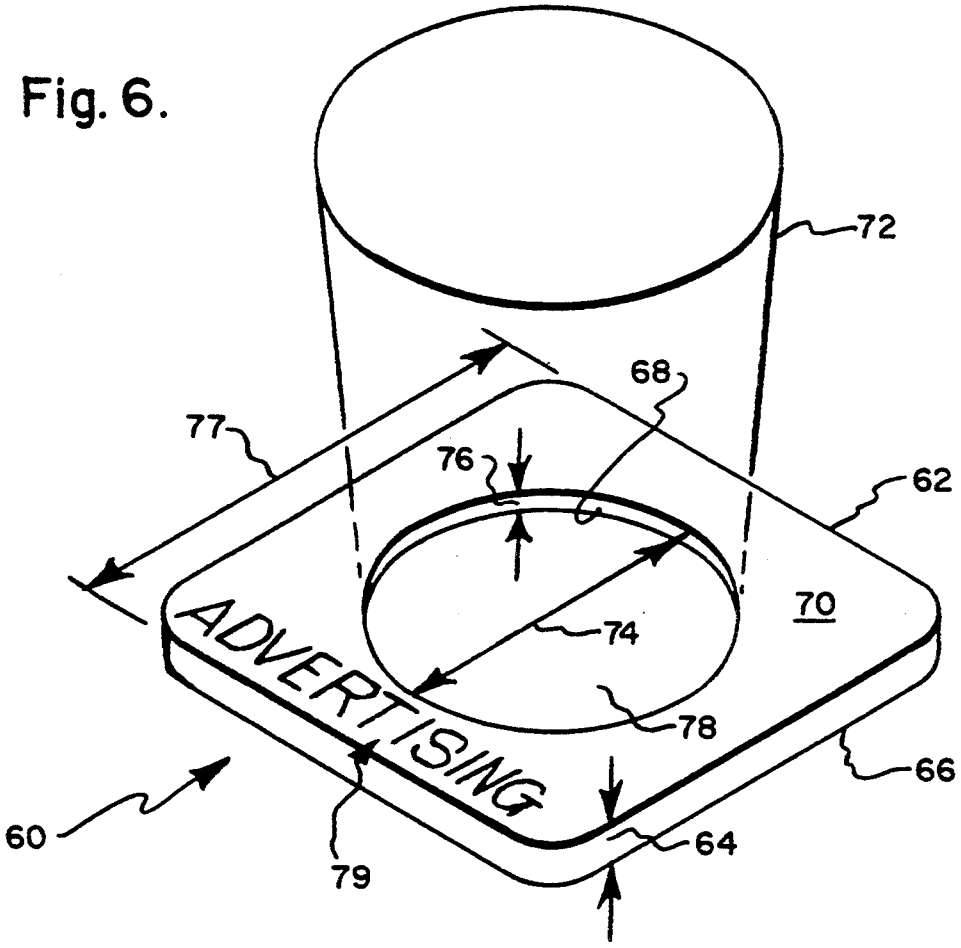
FIG. 6 is a perspective view of a coaster in accordance with another alternative embodiment of the present invention and illustrating its use with a beverage container.

Referring to FIGS. 1 to 3, there is shown generally at 10 a coaster for use, for example, on a commercial airplane tray, illustrated at 12, for receiving a beverage container, illustrated at 14, such as a cup for coffee or soda. While having particular applicability to beverage containers in use on moving vehicles, as described hereinafter, it should be understood that the coaster of the present invention may have applicability for use with various other implements such as plates or food trays at a picnic. Thus, a "coaster", for the purposes of this specification and the claims is defined as a member which is suitable for interposing between an implement and a table surface or other surface.

A common problem during flight is a tendency of a beverage container to tip over or to slide across a tray during turbulence sometimes resulting in spillage of the beverage, if the passenger does not carefully hold to the container. In order to prevent or reduce such a tendency of the beverage container 14 to tip over or slide, in accordance with the present invention the coaster 10 is provided with a slide-resistant lower surface 16 and an upper surface which adheres to the bottom of the cup 14.

For use by a commercial airliner, the coaster 10 should be thin so that a quantity thereof can be packed in a small volume and inexpensive so that it is disposable. In order to provide a coaster 10 which is suitably thin and inexpensive, in accordance with one embodiment of the present invention the coaster 10 is composed of a single thin disc 20 of material suitably adhesively treated to provide the slide-resistant surface 16 and the adhesive surface 18.

The disc 20 is a thin member composed of an inexpensive rigid material such as, for example, 35 to 40 point pulp board or chip board, to which is applied a suitable adhesive material 24 on the upper surface 18 to provide adhesive attachment to the cup 14 and a suitable adhesive 22 or other non-skid substance coated or laminated to the lower surface 16 to provide slide-resistance. By "thin" with reference to a disc or member is meant, for the purposes of this specification and the claims, a thickness, illustrated at 26, which is about ⅛ inch or less. In order to maintain compactness of a quantity of discs during shipment and storage as well as provide convenience to the user, the thickness 26 of the disc is minimized. Preferably, the thickness 26 is less than about 1/16 inch, for example, about 1/32 inch.

In accordance with the present invention the adhesive material 24 has sufficient strength to effect adherence between the disc 20 and the bottom of the cup so that when the cup 14 is picked up for drinking, as illustrated at 28 in FIG. 3, the disc 20 remains adhered to the cup bottom. On the other hand, the adhesive material 22 provides sufficient strength or tackiness between the disc 20 and the tray 12 to resist sliding of the disc, but the adhesive material 22 has less strength or tackiness than that of adhesive material 24 so that the disc 20 may easily separate from the tray 12 when the cup 14 is picked up. Preferably, the strength or tackiness of adhesive material 22 is such that it provides a vertical separation force between the disc 20 and tray 12 of between about 0.25 and 0.5 pounds and a horizontal separation force therebetween of between about 2 and 3 pounds. Preferred adhesive materials, supplied by Ellsworth Adhesive Systems of Fairview, Pa., are their H3500 adhesive for adhesive material 24 and their H3305 adhesive for adhesive material 22. The H3305 adhesive has less tack or is removable, and the H3500 adhesive is a clear permanent adhesive. Each of the adhesives 22 and 24 may suitably be applied to a thickness of perhaps about 2 mils. The tackiness of the H3305 adhesive may be varied by varying its thickness, in accordance with principles commonly known to those of ordinary skill in the art to which this invention pertains, for achieving the desired slide-resistance. Styrofoam, glass, and plastic cups have all been found to work well with H3500 adhesive.

Peelable release paper 30 and 32 is provided to cover the adhesive materials 22 and 24 respectively prior to use of the coaster 10. Release paper 30 may be found to be unnecessary. Release paper 30 and 32 may, for example, be either 1 mil polyethylene sheet or No. 8815 release paper supplied by H. P. Smith Inc. of 14567 Polo Drive, Strongsville, Ohio 44136. To use the coaster, the release paper 30 and 32 is peeled away and discarded and the coaster placed on the tray bottom side 16 down to contact the tray 12. The cup 14 may then be placed on the coaster 10 to thereby adhere thereto so that it remains adhered to the bottom of the cup as it is picked up for drinking or set down. The adhesive 22 resists sliding of the coaster along the tray in the event of turbulence.

The disc 20 is shown to be circular in shape for use suitably with cups having circular bottoms. However, it should be understood that, in accordance with the present invention, a coaster may comprise a member having another suitable shape such as square.

In accordance with the present invention the disc 20 is sized to cover the bottom of the cup 14 and to extend outwardly beyond the cup bottom edge all around the perimeter thereof. With the cup bottom adhered to the disc 20, this effects an increase in the cup footprint so as to increase the resistance of the cup to tipping over. However, as the disc diameter increases, it may become more difficult to use as well as more expensive to manufacture. For suitable use with cups having diameters (at the bottom) up to about 2 inches typically used on commercial airplanes, the disc 20 preferably has a diameter, illustrated at 34, of between about 3 and 4 inches, more preferably about 3 inches. If the disc is non-circular, its dimensions would be selected, in accordance with principles commonly known to those of ordinary skill in the art to which this invention pertains, to provide an equivalent footprint.

A logo or advertisement, illustrated at 36, may be suitably provided on the upper surface 18 along the perimeter of the disc 20, as shown in FIG. 1. Such advertising 36 may be custom-printed on the disc 20.

It should be understood that the coaster may be composed of other suitable disc material, adhesive materials, and release paper than those described.

Referring to FIGS. 4 and 5, there is shown at 40 a coaster in accordance with an alternative embodiment of the present invention. Coaster 40 is composed of a single thin disc 42 which is preferably composed of rubber providing a naturally high coefficient of friction for sliding resistance of its lower surface 44 which may be enhanced by a finely grooved lower surface 44, as illustrated by ridges 46 defining grooves 48 in FIG. 4. Alternatively, disc 42 may be composed of other suitable materials providing sufficiently high sliding resistance. For example, disc 42 may be composed of cardboard having a rough textured or embossed pebble surface. Thus, an adhesive is not required on the lower surface 44 but may be provided if desired. The thickness and diameter of the disc 42 may be similar to the thickness 26 and diameter 34 of disc 20. By rubber, as used in this specification and the claims, is meant to include vinyl and other rubber-like materials providing an equivalent high coefficient of friction for sliding resistance. An adhesive material 50 similar to adhesive 24 is applied to the upper surface 52 for adhesively attaching the upper surface 52 to the bottom of a cup. Peelable backing paper 54, similar to backing paper 32, may be provided to cover the adhesive 50 prior to use of the coaster 40.

Referring to FIG. 6, there is illustrated generally at 60 a coaster in accordance with an alternative embodiment of the present invention. Coaster 60 comprises a generally square member 62 composed of a single piece of material similar to that of which either of discs 20 and 42 is composed. Member 62 has a thickness, illustrated at 64, which is between about ⅛ and ¼ inch. Member 62 has a slide-resistant lower surface, illustrated at 66, provided by an adhesive similar to adhesive 22 or is similar to surface 44 or otherwise suitably provided. An indent 68 is provided in the upper surface 70 centrally of the member 62 and sized to receive the bottom of a beverage container 72, the diameter 74 of the indent 68 being substantially equal to the diameter of the bottom of the container 72, so that the container 72 may be held in the indent 68 against sliding or tipping over. The indent 68 has a depth, illustrated at 76, which is suitably about half of thickness 64. For a cup having a bottom diameter of 2 inches, each of the edges of disc 62 may have a length, illustrated at 77, of preferably between about 3 and 4 inches, more preferably, 3 inches square. The indent 68 may be provided by debossing under pressure or by other suitable means. The upper surface 70 of course does not require an adhesive. However, an adhesive, illustrated at 78, similar to adhesive 24, may, if desired, be applied to the bottom surface of the indent 68 to effect adhesive attachment of the cup bottom to the coaster 60. Advertising, illustrated at 79, may be provided on the upper surface 70 similarly as advertising 36 is provided. Coaster 60 may be provided for use by, for example, small children or recovering patients or patients being rehabilitated.

Figure 7:
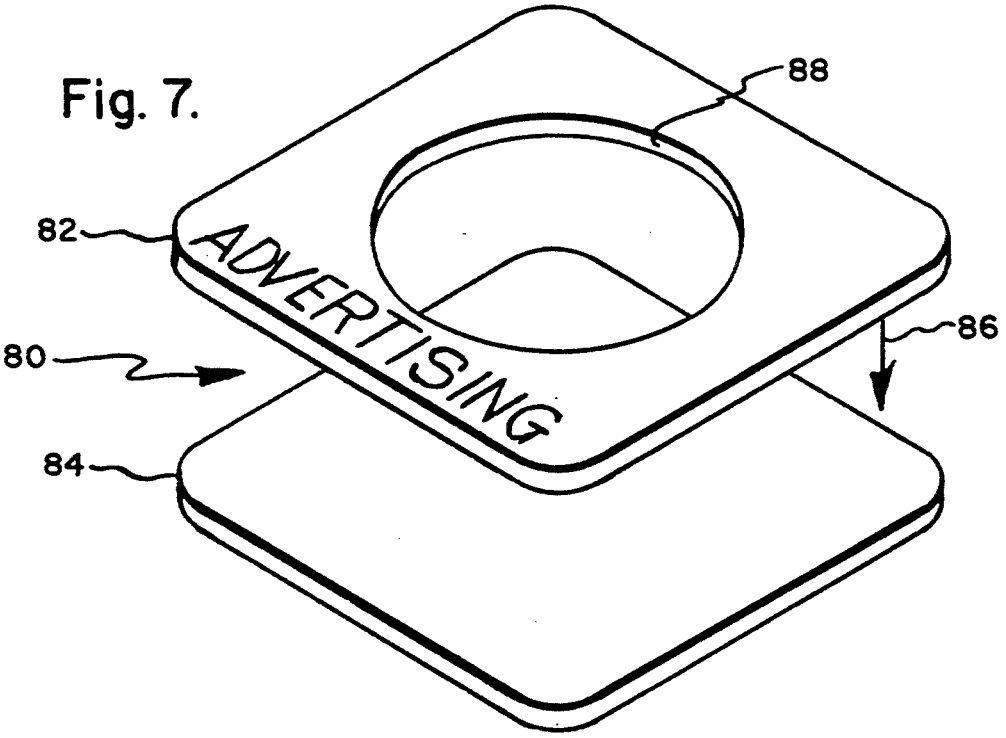
FIG. 7 is a perspective exploded view of a coaster in accordance with yet another embodiment of the present invention.

Referring to FIG. 7, there is illustrated generally at 80 a coaster similar to coaster 60 but made from upper and lower portions 82 and 84 respectively adhesively or otherwise suitably attached, as illustrated by arrow 86. Upper portion 82 has a central aperture 88 which, when portions 82 and 84 are attached, forms an indent similar to indent 68.

It is thus seen that an inexpensive and thin coaster in accordance with the present invention may achieve the following for the user:

1. It may increase the footprint of a drinking container to aid in preventing the container from tipping over and spilling its contents.
2. It may prevent the drinking container from sliding off any surface on which it is placed during use of the drinking container.
3. It may also allow advertising on its upper surface.

Although illustrated herein for use with drinking containers on, for example, moving vehicles, it is so be understood that a coaster in accordance with the present invention may be provided and sized for use with other implements. For example, a coaster which embodies the present invention may be adhesively attachable to the bottom of a suitable base having a generally flat lower surface for an arm constraint, such as shown in U.S. Pat. No. 4,784,120 to Thomas the disclosure of which is incorporated herein by reference, to provide slip-resistance thereof relative to a table or bedside tray stand on which it is removably set. The arm constraint is provided to aid in self-feeding of a person, afflicted with tremors, from a plate which is set on the upper surface of a mount attached to the arm constraint. A suitable coaster which embodies the present invention may also be adhesively attachable to the lower surface of the plate to provide slip-resistance relative to the mount. A suitable coaster which embodies the present invention may also be provided on the lower surface of a plate for use, for example, by children, recovering patients being rehabilitated, or by persons on a picnic.

It should be understood that, while the present invention has been described in detail herein, it can be embodied otherwise without departing from the principles thereof, and such other embodiments are meant to come within the scope of the present invention as defined by the appended claims.

What is claimed is:

1. A slide resistant coaster for use in a moving vehicle comprising a thin member composed of a single piece of material having a thickness which is less than about ⅛ inch and including an upper surface, a slide-resistant lower surface for engaging a supporting surface, an adhesive material on said upper surface for adhesively attaching said member to the bottom of an implement so as to remain attached to the bottom of the implement when the implement is picked up, and an adhesive material on said lower surface, said adhesive material on said upper surface having greater tackiness than said lower surface adhesive material.

2. A coaster according to claim 1 wherein the coaster is sized for use with a beverage container.

3. A coaster according to claim 1 for use with a beverage container wherein said member is sized to extend outwardly from the bottom of the beverage container over the periphery thereof for increasing the footprint thereof.

4. A coaster according to claim 1 further comprising advertising means on said upper surface.

5. A coaster according to claim 1 further comprising peelable backing paper on said upper and lower surfaces.

6. A coaster according to claim 1 wherein said member is composed of a single piece of rubber.

7. A coaster according to claim 6 further comprising peelable backing paper on said upper surface.

8. A coaster according to claim 1 wherein said member has a diameter which is between about 3 and 4 inches.

9. A coaster according to claim 1 wherein said single piece of material has a thickness which is less than about 1/16 inch.

10. For use in a moving vehicle on a supporting surface, a slide-resistant coaster comprising a thin member composed of a single piece of material having a thickness which is less than about ⅛ inch and including an upper surface, a slide-resistant lower surface characterized by providing a vertical separation force between said member and the supporting surface which is between about 0.25 and 0.5 pounds and a horizontal separation force between said member and the supporting surface which is between about 2 and 3 pounds, an adhesive material on said upper surface for adhesively attaching said member to the bottom of an implement so as to remain attached to the bottom of the implement when the implement is picked up, and an adhesive material on said lower surface, said adhesive material on said upper surface having greater tackiness than said lower surface adhesive material.

11. A coaster according to claim 11 wherein said member diameter is equal to about 3 inches.

12. A coaster according to claim 10 further comprising peelable backing paper on said upper surface.

13. A coaster according to claim 10 wherein said single piece of material has a thickness which is less than about 1/16 inch.

14. A coaster according to claim 10 further comprising peelable backing paper on said upper and lower surfaces.

15. A coaster according to claim 10 wherein said member is composed of a single piece of rubber.

16. A coaster according to claim 10 for use with a beverage container wherein said member is sized to extend outwardly from the bottom of the beverage container over the periphery thereof for increasing the footprint thereof.

17. A method of restraining movement of a beverage container on a supporting surface in a moving vehicle comprising placing on the supporting surface a slide-resistant coaster comprising a thin member composed of a single piece of material having a thickness which is less than about ⅛ inch and including a slide-resistant lower surface characterized by providing a vertical separation force between the member and the supporting surface which is between about 0.25 and 0.5 pounds and a horizontal separation force between the member and the supporting surface which is between about 2 and 3 pounds and further including an adhesive material on an upper surface thereof for adhesively attaching the member to a bottom of the beverage container so as to remain attached to the bottom of the beverage container when the beverage container is picked up, the method further comprising placing the beverage container on the coaster so that the bottom of the beverage container is adhesively attached to the coaster whereby to restrain sliding of the beverage container along the supporting surface during movement of the vehicle.

* * * * *